US012281585B2

(12) United States Patent
Takata et al.

(10) Patent No.: US 12,281,585 B2
(45) Date of Patent: Apr. 22, 2025

(54) DRAIN REMOVAL MONITORING EQUIPMENT

(71) Applicant: MITSUBISHI HEAVY INDUSTRIES, LTD., Tokyo (JP)

(72) Inventors: Ryo Takata, Tokyo (JP); Masaki Osako, Tokyo (JP); Masahiro Ishikawa, Tokyo (JP); Hideaki Sato, Yokohama (JP); Soichiro Tabata, Yokohama (JP); Naoto Tochitani, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 266 days.

(21) Appl. No.: 17/921,157

(22) PCT Filed: May 13, 2021

(86) PCT No.: PCT/JP2021/018215

§ 371 (c)(1),
(2) Date: Oct. 25, 2022

(87) PCT Pub. No.: WO2021/235314

PCT Pub. Date: Nov. 25, 2021

(65) Prior Publication Data

US 2023/0243273 A1 Aug. 3, 2023

(30) Foreign Application Priority Data

May 20, 2020 (JP) ..... 2020-087905

(51) Int. Cl.
*F01D 21/00* (2006.01)

(52) U.S. Cl.
CPC ..... *F01D 21/003* (2013.01)

(58) Field of Classification Search
CPC ..... F01D 21/003; F01D 25/32; F01D 9/02; F01D 25/00; F05D 2220/31; F05D 2260/602; F05D 2270/306
(Continued)

(56) References Cited

FOREIGN PATENT DOCUMENTS

CN 207454045 U * 6/2018
JP 62-157206 A 7/1987
(Continued)

OTHER PUBLICATIONS

Office Action dated Jun. 27, 2023, issued in counterpart DE application No. 11 2021 001 297.5. (6 pages).
(Continued)

*Primary Examiner* — Robert R Raevis
(74) *Attorney, Agent, or Firm* — WHDA, LLP

(57) ABSTRACT

A drain removal monitoring equipment for monitoring, in a steam turbine, drain removal performed by drawing a fluid outside at least one hollow stator vane including an internal space into the internal space via a slit formed in a surface of the stator vane includes: a gas-liquid separation device for separating the fluid drawn into the internal space into a liquid phase and a gas phase; a liquid-phase flow measurement device for measuring a flow rate of the liquid phase separated by the gas-liquid separation device; a gas-phase flow measurement device for measuring a flow rate of the gas phase separated by the gas-liquid separation device; a liquid-phase return line through which the liquid-phase flow measurement device and the steam turbine communicate with each other, and a gas-phase return line through which the gas-phase flow measurement device and the steam turbine communicate with each other.

9 Claims, 12 Drawing Sheets

(58) Field of Classification Search
USPC ..... 73/112.02, 865.8, 865.9, 432.1; 60/227, 60/775, 39.26, 39.3, 328
See application file for complete search history.

(56) References Cited

FOREIGN PATENT DOCUMENTS

| | | | |
|---|---|---|---|
| JP | H04-41908 | A | 2/1992 |
| JP | 6121294 | B2 | 4/2017 |

OTHER PUBLICATIONS

International Search Report dated Jul. 20, 2021, issued in counterpart International Application No. PCT/JP2021/018215 (2 pages).

* cited by examiner

DRAIN REMOVAL MONITORING EQUIPMENT

TECHNICAL FIELD

The present disclosure relates to drain removal monitoring equipment.

This application claims the priority of Japanese Patent Application No. 2020-87905 filed on May 20, 2020, the content of which is incorporated herein by reference.

BACKGROUND

In a steam turbine, collision of water droplets on a rotor blade may cause erosion damage to the rotor blade. Patent Document 1 discloses a steam turbine capable of removing drain by forming a slit, through which an internal space inside a hollow stator vane and the outside of the stator vane communicate with each other, in a vane surface of the stator vane, and drawing water (liquid phase) adhering to the surface of the stator vane into the internal space via the slit due to a pressure difference. In the steam turbine, drain is removed by adjusting the pressure difference between the outside of the stator vane and the internal space to an appropriate pressure difference according to a turbine load fluctuation.

CITATION LIST

Patent Literature

Patent Document 1: JPS62-157206A

SUMMARY

Technical Problem

However, not only the liquid phase but also a gas phase is draw into the internal space via the slit. Thus, it is actually unknown whether drain is properly removed. In order to ascertain whether drain is properly removed, it is necessary to measure the flow rates of both the liquid phase and the gas phase drawn into the internal space via the slit.

In view of the above, an object of at least one embodiment of the present disclosure is to provide drain removal monitoring equipment capable of ascertaining whether drain is properly removed.

Solution to Problem

In order to achieve the above object, a drain removal monitoring equipment according to the present disclosure is a drain removal monitoring equipment for monitoring, in a steam turbine, drain removal performed by drawing a fluid outside at least one hollow stator vane including an internal space into the internal space via a slit formed in a surface of the stator vane, that includes: a gas-liquid separation device for separating the fluid drawn into the internal space into a liquid phase and a gas phase; a liquid-phase flow measurement device for measuring a flow rate of the liquid phase separated by the gas-liquid separation device; a gas-phase flow measurement device for measuring a flow rate of the gas phase separated by the gas-liquid separation device; a liquid-phase return line through which the liquid-phase flow measurement device and the steam turbine communicate with each other; and a gas-phase return line through which the gas-phase flow measurement device and the steam turbine communicate with each other.

Advantageous Effects

According to drain removal monitoring equipment of the present disclosure, since the flow rates of both a liquid phase and a gas phase in a fluid drawn into an internal space of a stator vane of a steam turbine via a slit formed in the stator vane are measured, it is possible to ascertain whether drain is properly removed.

DETAILED DESCRIPTION

Hereinafter, drain removal monitoring equipment according to the embodiments of the present disclosure will be described with reference to the drawings. The embodiments each indicate one aspect of the present disclosure, do not intend to limit the disclosure, and can optionally be modified within a range of a technical idea of the present disclosure.

Embodiment 1

<Configuration of Drain Removal Monitoring Equipment According to Embodiment 1 of Present Disclosure>

Figure 1:
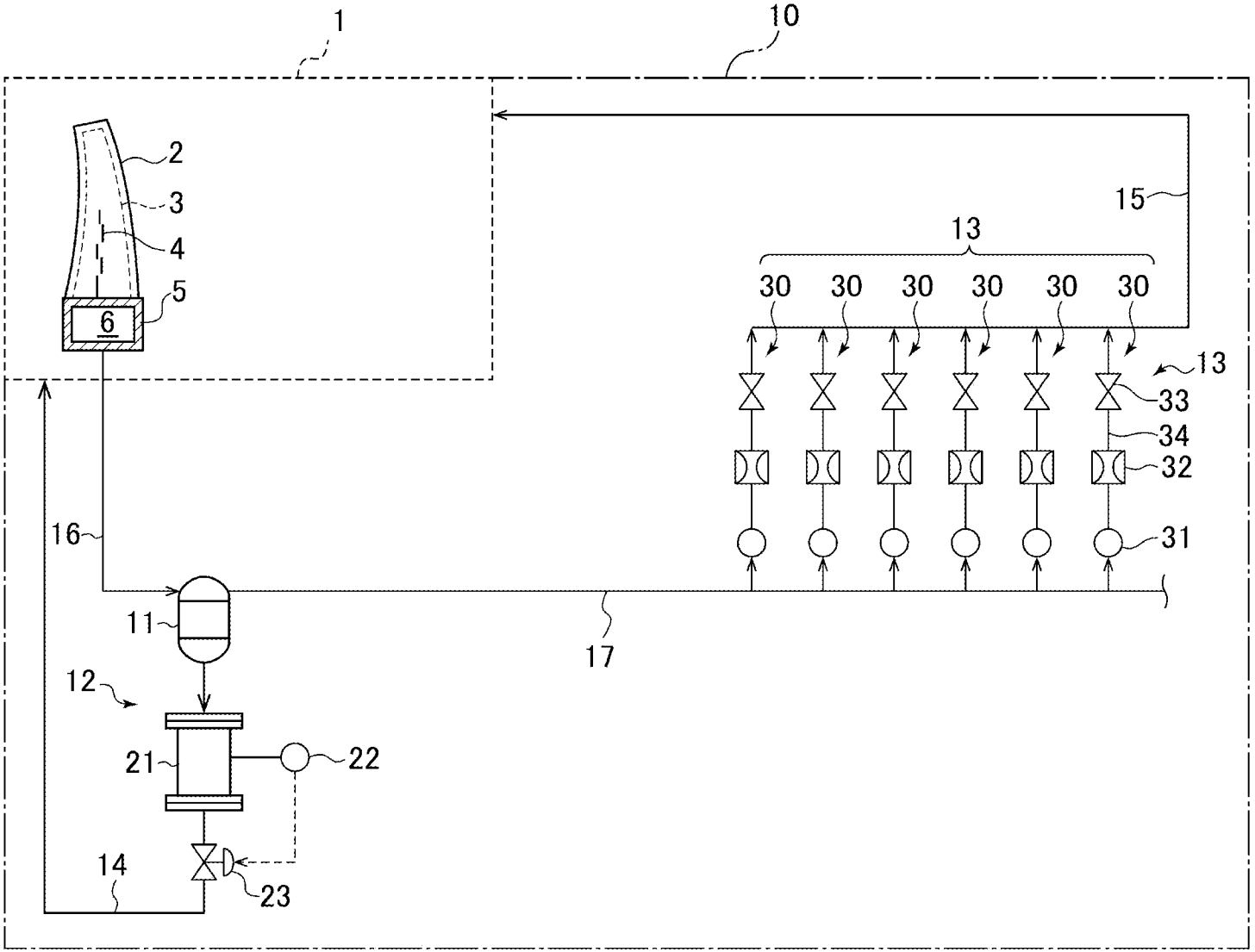
FIG. 1 is a schematic view showing the configuration of drain removal monitoring equipment according to Embodiment 1 of the present disclosure.

As shown in FIG. 1, drain removal monitoring equipment 10 according to Embodiment 1 is provided to monitor, in a steam turbine 1, drain removal performed by drawing a fluid outside at least one hollow stator vane 2 including an internal space 3 into the internal space 3 via a slit 4 formed in a surface of the stator vane 2. A diaphragm 5 connected to the stator vane 2 is formed into a hollow shape including an internal space 6, and the internal space 6 and the internal space 3 communicate with each other. Although not shown in FIG. 1, the steam turbine 1 includes a turbine with the stator vane 2, a turbine outlet exhaust casing, and a condenser casing.

The drain removal monitoring equipment 10 includes a gas-liquid separation device 11 for separating a fluid with a liquid phase and a gas phase into a liquid phase and a gas phase, a liquid-phase flow measurement device 12 for measuring the flow rate of the liquid phase separated by the gas-liquid separation device 11, a gas-phase flow measurement device 13 for measuring the flow rate of the gas phase separated by the gas-liquid separation device 11, a liquid-phase return line 14 through which the liquid-phase flow measurement device 12 and the steam turbine 1 communicate with each other, and a gas-phase return line 15 through which the gas-phase flow measurement device 13 and the steam turbine 1 communicate with each other.

The drain removal monitoring equipment 10 further includes a two-phase flow line 16 through which the internal space 6 in the diaphragm 5 and the gas-liquid separation device 11 communicate with each other. Since the internal space 6 and the internal space 3 communicate with each other, the two-phase flow line 16 causes the internal space 3 and the gas-liquid separation device 11 to communicate with each other via the internal space 6. In addition, the drain removal monitoring equipment 10 further includes a gas-phase flow line 17 through which the gas-liquid separation device 11 and the gas-phase flow measurement device 13 communicate with each other.

The configuration of the gas-liquid separation device 11 is not particularly limited, and it is possible to use, for example, a device of a corrugated plate type or a demister type by mesh or the like, or a cyclone type cyclone separator. However, the cyclone type configuration has a wider flow rate range capable of maintaining gas-liquid separation with low pressure loss and high performance than the configuration of mesh or the like, and it is possible to follow a change in measurement conditions or expand a control range. Therefore, the cyclone separator is preferably used as the gas-liquid separation device 11.

The configuration of the liquid-phase flow measurement device 12 is not particularly limited, and a measurement device with any configuration can be used. As an example of the liquid-phase flow measurement device 12, it is possible to use a device that includes a tank part 21 for storing the liquid phase separated by the gas-liquid separation device 11 and a liquid-phase amount detection part 22 for detecting the amount of the liquid phase in the tank part 21. As the liquid-phase amount detection part 22, it is possible to use a liquid level meter for detecting the liquid level of the liquid phase in the tank part 21. As the liquid level meter, it is possible to use a float-type meter, or a meter for detecting the liquid level by light, infrared rays, ultrasonic waves, or the like.

If the liquid-phase flow measurement device 12 has a configuration including the tank part 21, an end of the liquid-phase return line 14 is preferably connected to a bottom of the tank part 21. Further, in this case, the liquid-phase return line 14 may be provided with a drainage valve 23 that can automatically be opened and closed according to a value detected by the liquid-phase amount detection part 22. For example, an upper limit value is set in advance for the value detected by the liquid-phase amount detection part 22, and the drainage valve 23 can be opened if the value detected by the liquid-phase amount detection part 22 reaches the upper limit value.

The configuration of the gas-phase flow measurement device 13 is not particularly limited, and a measurement device with any configuration can be used. As an example of the gas-phase flow measurement device 13, it is possible to use a device provided with a plurality of measurement mechanisms 30 each of which includes a pressure gauge 31 for measuring a pressure of the gas phase, a critical nozzle 32 disposed downstream of the pressure gauge 31, and an opening and closing valve 33 disposed downstream of the critical nozzle 32. As the critical nozzle 32, although any nozzle such as an orifice nozzle or a Laval nozzle can be used, the Laval nozzle is preferably used for the reasons described later.

In FIG. 1, the gas-phase flow measurement device 13 includes six measurement mechanisms 30. However, the number is not limited to six, and the gas-phase flow measurement device 13 may include only one measurement mechanism 30 or may include any number, other than six, of measurement mechanisms 30. Each measurement mechanism 30 includes a gas-phase flow pipe 34 through which the gas phase flows. The gas-phase flow pipes 34 may all have the same inner diameter or may all have different inner diameters, or some of the gas-phase flow pipes 34 may have the same inner diameter and the others may have the different inner diameters.

<Operation of Drain Removal Monitoring Equipment According to Embodiment 1 of Present Disclosure>

Next, an operation of the drain removal monitoring equipment 10 according to Embodiment 1 of the present disclosure will be described. During an operation of the steam turbine 1, a fluid is drawn into the internal space 3 via the slit 4. Herein, the drawn fluid includes the liquid phase adhering to the surface of the stator vane 2, that is, liquid water or a working fluid of the steam turbine 1 passing through the stator vane 2, that is, the gas phase and the liquid phase in steam. The fluid drawn into the internal space 3 flows into the two-phase flow line 16 via the internal space 6 and flows through the two-phase flow line 16.

The fluid flowing through the two-phase flow line 16 flows into the gas-liquid separation device 11, and is separated into the liquid phase and the gas phase. The liquid phase, that is, the liquid water flows into the tank part 21 of the liquid-phase flow measurement device 12 and is stored in the tank part 21. On the other hand, the gas phase flows through the gas-phase flow line 17 and flows into the gas-phase flow measurement device 13.

In the liquid-phase flow measurement device 12, the liquid-phase amount detection part 22 detects transition of the water level of the water in the tank part 21. Since the amount of the water in the tank part 21 can be calculated from the water level of the water in the tank part 21, based on the value detected by the liquid-phase amount detection part 22, transition of the flow rate of the liquid phase in the fluid drawn into the internal space 3 is obtained.

By opening the drainage valve 23 if the water level in the tank part 21 reaches the upper limit value, the water in the tank part 21 is drained from the tank part 21 and flows into the steam turbine 1, or more specifically a condenser (not shown) via the liquid-phase return line 14. As described above, since the liquid phase can automatically be drained from the tank part 21, long-term monitoring is possible.

On the other hand, in the gas-phase flow measurement device 13, the gas phase flows into at least one measurement mechanism 30. If the gas-phase flow measurement device 13 includes the plurality of measurement mechanisms 30, the number of measurement mechanisms 30 into which the gas phase flows can be adjusted by opening and closing the opening and closing valve 33 of each measurement mechanism 30, thereby making it possible to adjust a pressure difference between upstream and downstream of the slit 4, and the flow rate of the two-phase flow drawn into the internal space 3 via the slit 4, the details of which are to be described later in Embodiment 5.

The gas phase having flown into the measurement mechanism 30 flows into the critical nozzle 32 after the pressure is measured by the pressure gauge 31. The gas phase having flown into the critical nozzle 32 flows out of the critical nozzle 32 with a flow passage area being enlarged again after the flow passage area is narrowed. By using the critical nozzle 32 in the gas-phase flow measurement device 13, the flow rate of the gas-phase can be measured only by an upstream pressure of the critical nozzle 32.

Figure 2:
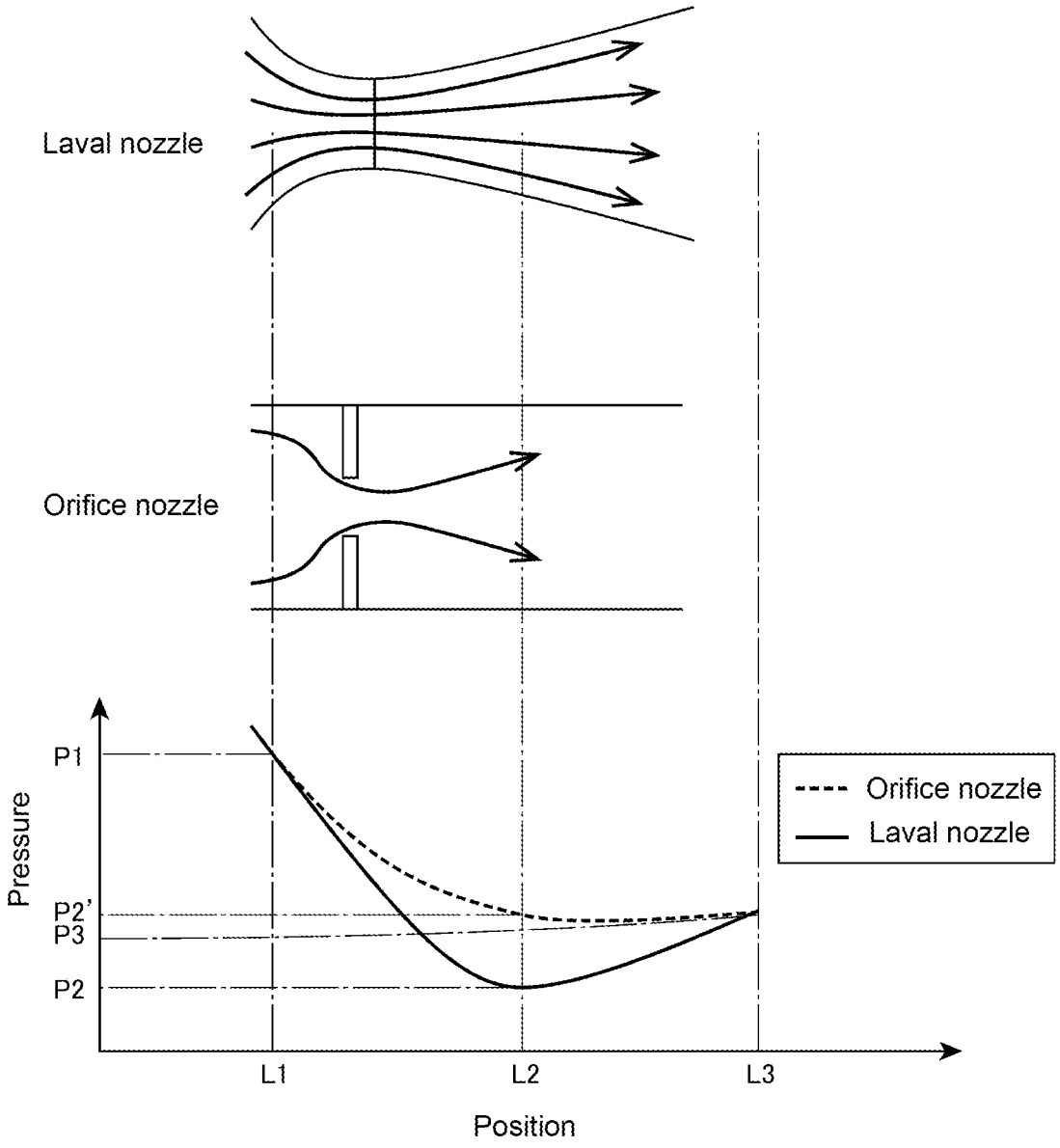
FIG. 2 is a graph showing a comparison between a case where an orifice nozzle is used and a case where a Laval nozzle is used as a critical nozzle used in a gas-phase flow measurement device of the drain removal monitoring equipment according to Embodiment 1 of the present disclosure.

FIG. 2 shows a comparison between a case where an orifice nozzle is used and a case where a Laval nozzle is used as the critical nozzle 32. A pressure P1 at a position L1 before the flow passage area is narrowed in the critical nozzle 32 is the pressure measured by the pressure gauge 31 (see FIG. 1), and is the same for any nozzles. P2<P2' is satisfied, where P2 is a pressure at a position L2 after the flow passage area is narrowed in the critical nozzle 32 in the case of the Laval nozzle and P2' is a pressure at the position L2 after the flow passage area is narrowed in the critical nozzle 32 in the case of the orifice nozzle. A pressure P3 at a sufficiently downstream position L3 is the same for any nozzles.

If a pressure ratio P1/P3 is sufficiently high, pressure ratios P1/P2 and P1/P2' reach the critical pressure ratio, and thus the flow rate of the gas phase can be calculated from the value measured by the pressure gauge 31. However, if the downstream pressure of the gas-phase flow measurement device 13, that is, the pressure P3 increases due to operating conditions of the steam turbine 1, the critical pressure ratio may not be reached in the critical nozzle 32. To cope therewith, from the relation of P2<P2', the possibility of reaching the critical pressure ratio can be increased by using the Laval nozzle as the critical nozzle 32, making it possible to enhance reliability of flow measurement of the gas phase. Therefore, it is preferable to use the Laval nozzle as the critical nozzle 32.

Thus, in the drain removal monitoring equipment 10 according to Embodiment 1 of the present disclosure, since the flow rates of both the liquid phase and the gas phase in the fluid drawn into the internal space 3 inside the stator vane 2 of the steam turbine 1 via the slit 4 formed in the stator vane 2 are measured, it is possible to ascertain whether drain is properly removed.

<Regarding Abnormality Diagnosis of Drain Removal>

Figure 3:
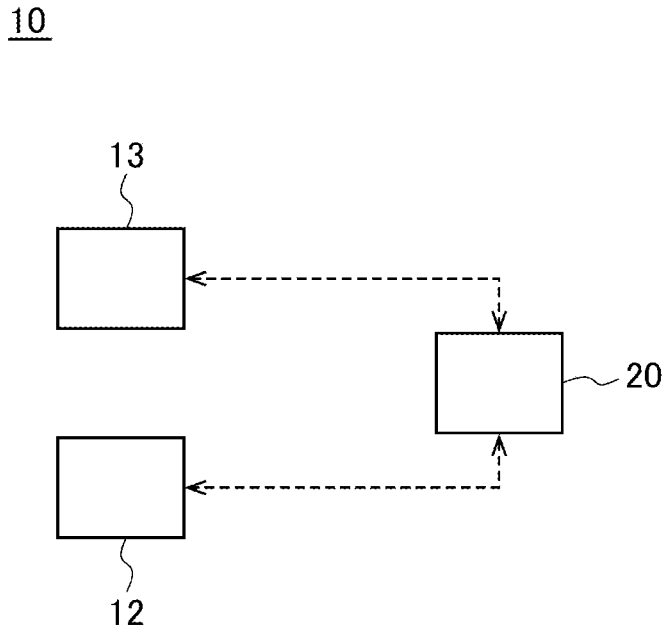
FIG. 3 is a block configuration diagram showing the preferred configuration of the drain removal monitoring equipment for diagnosing an abnormality in drain removal from the flow rates of a liquid phase and a gas phase in the drain removal monitoring equipment according to Embodiment 1 of the present disclosure.

Next, an example of diagnosing an abnormality in drain removal from the flow rates of the liquid phase and the gas phase respectively measured by the liquid-phase flow measurement device 12 and the gas-phase flow measurement device 13 will be described. In order to perform such diagnosis, as shown in FIG. 3, the drain removal monitoring equipment 10 preferably includes a control device 20 electrically connected to the liquid-phase flow measurement device 12 and the gas-phase flow measurement device 13.

The flow rates of the liquid phase and the gas phase respectively measured by the liquid-phase flow measurement device 12 and the gas-phase flow measurement device 13 are transmitted to the control device 20. The control device 20 is preset with an upper limit value and a lower limit value for the flow rate of the liquid phase and an upper limit value and a lower limit value for the flow rate of the gas phase, and the abnormality in drain removal is detected based on the respective flow rates of the liquid phase and the gas phase transmitted and the upper limit values and the lower limit values for the respective flow rates of the liquid phase and the gas phase. As long as the flow rate of the liquid phase and the flow rate of the gas phase fluctuate between the respective upper limit values and lower limit values, the control device 20 determines that drain is properly removed.

Figure 4:
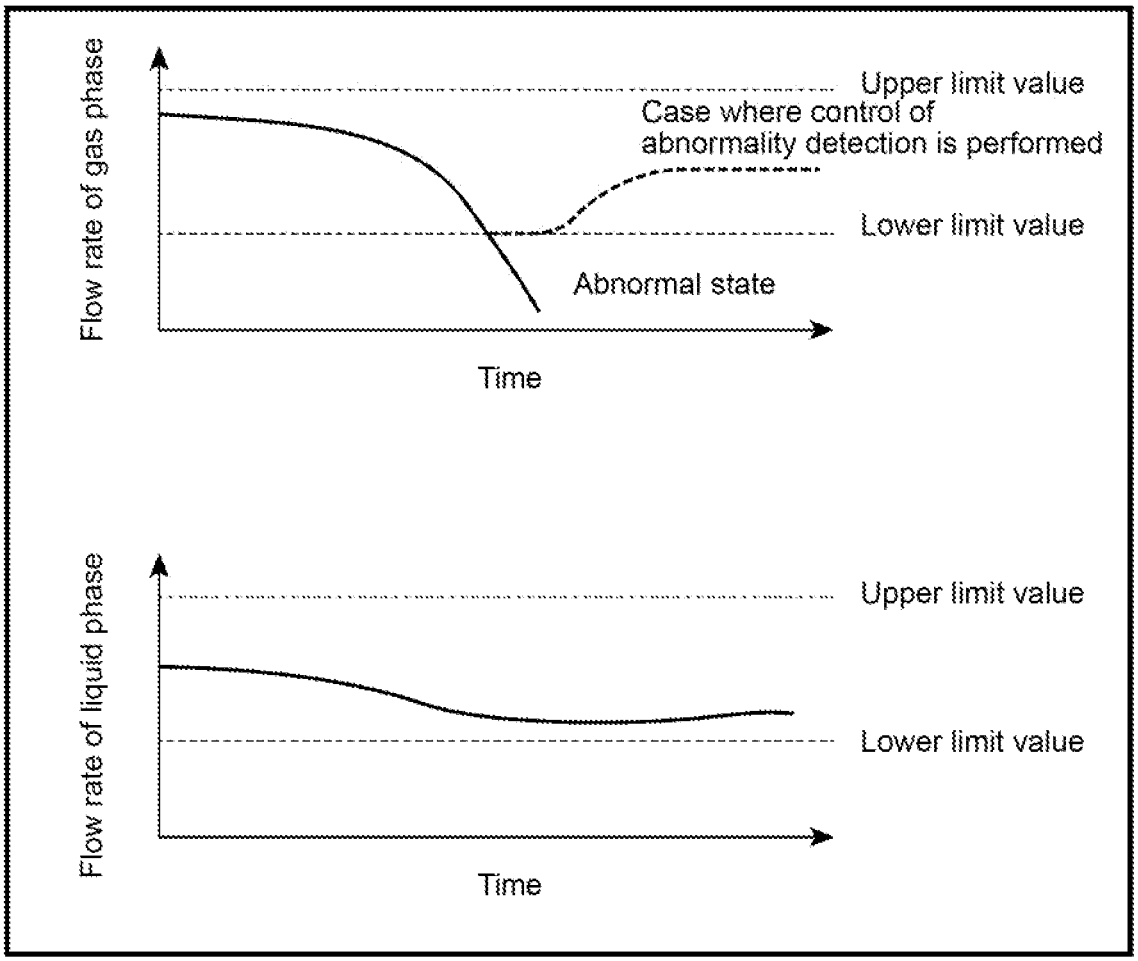
FIG. 4 is a graph showing an example of abnormality detection in drain removal.

For example, as shown in FIG. 4, if the flow rate of the gas phase may decrease and fall below the lower limit value even though the flow rate of the liquid phase fluctuates between the upper limit value and the lower limit value, the control device 20 (see FIG. 3) determines that there is an abnormality in which the fluid drawn into the internal space of the stator vane 2 (see FIG. 1) is reversely injected from the slit 4 (see FIG. 1). Occurrence of such abnormality increases the risk of erosion damage. In case such abnormality is detected, the control device 20 operates the opening and closing valve 33 (see FIG. 1) to increase the pressure ratio between upstream and downstream of the slit 4, thereby increasing the flow rate of the gas phase. If such control is performed, the flow rate of the gas phase increases and fluctuates between the upper limit value and the lower limit value, and drain is properly removed.

Figure 5:
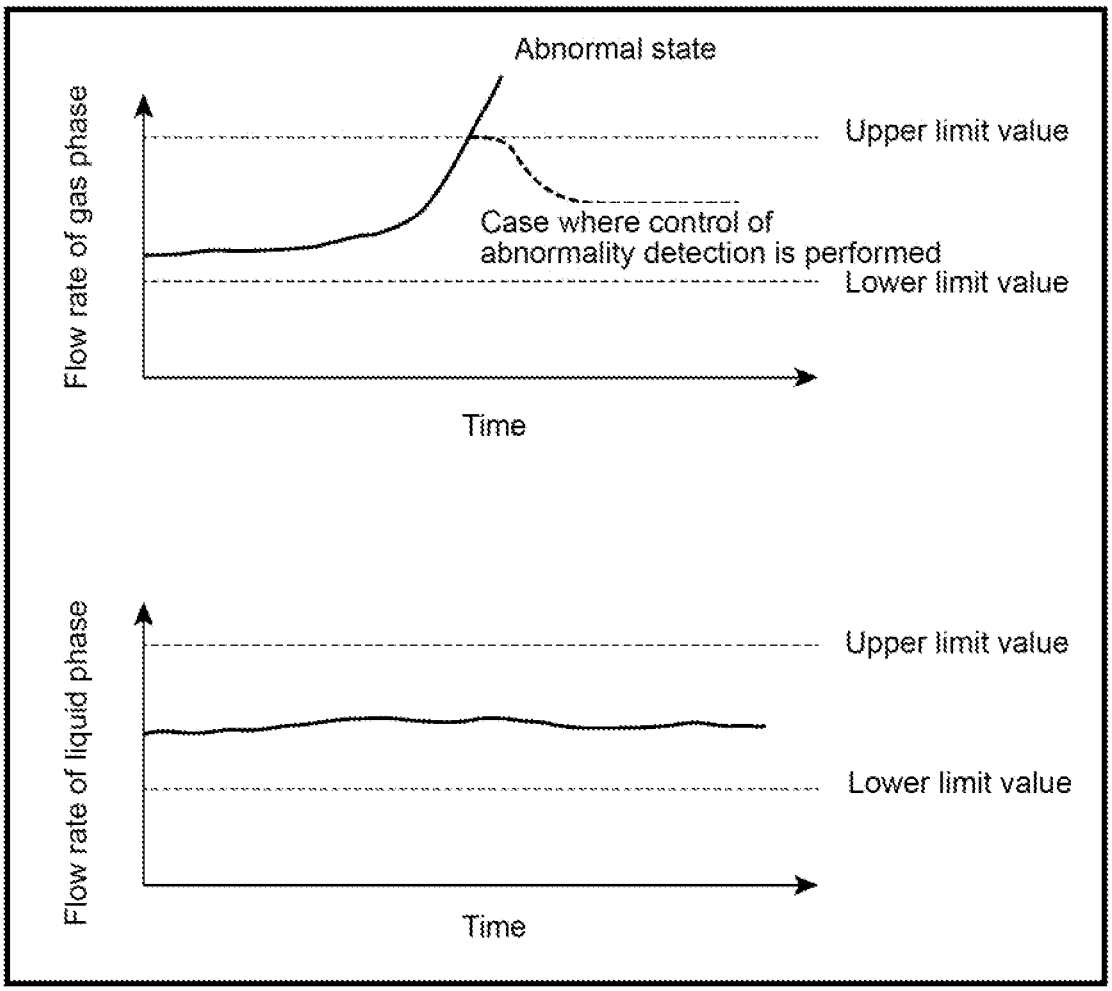
FIG. 5 is a graph showing an example of abnormality detection in drain removal.

For example, as shown in FIG. 5, if the flow rate of the gas phase may increase and exceed the upper limit value even though the flow rate of the liquid phase fluctuates between the upper limit value and the lower limit value, the control device 20 (see FIG. 3) determines that there is a possibility of an increase in gas pass due to deformation in the slit 4 (see FIG. 1) or the like. If such state is left, an output of the steam turbine 1 (see FIG. 1) will decrease. In case such abnormality is detected, the control device 20 operates the opening and closing valve 33 (see FIG. 1) within a range where the flow rate of the liquid phase does not fluctuate to reduce the pressure ratio between upstream and downstream of the slit 4. If such control is performed, the flow rate of the gas phase decreases and fluctuates between the upper limit value and the lower limit value, and drain is properly removed.

Figure 6:
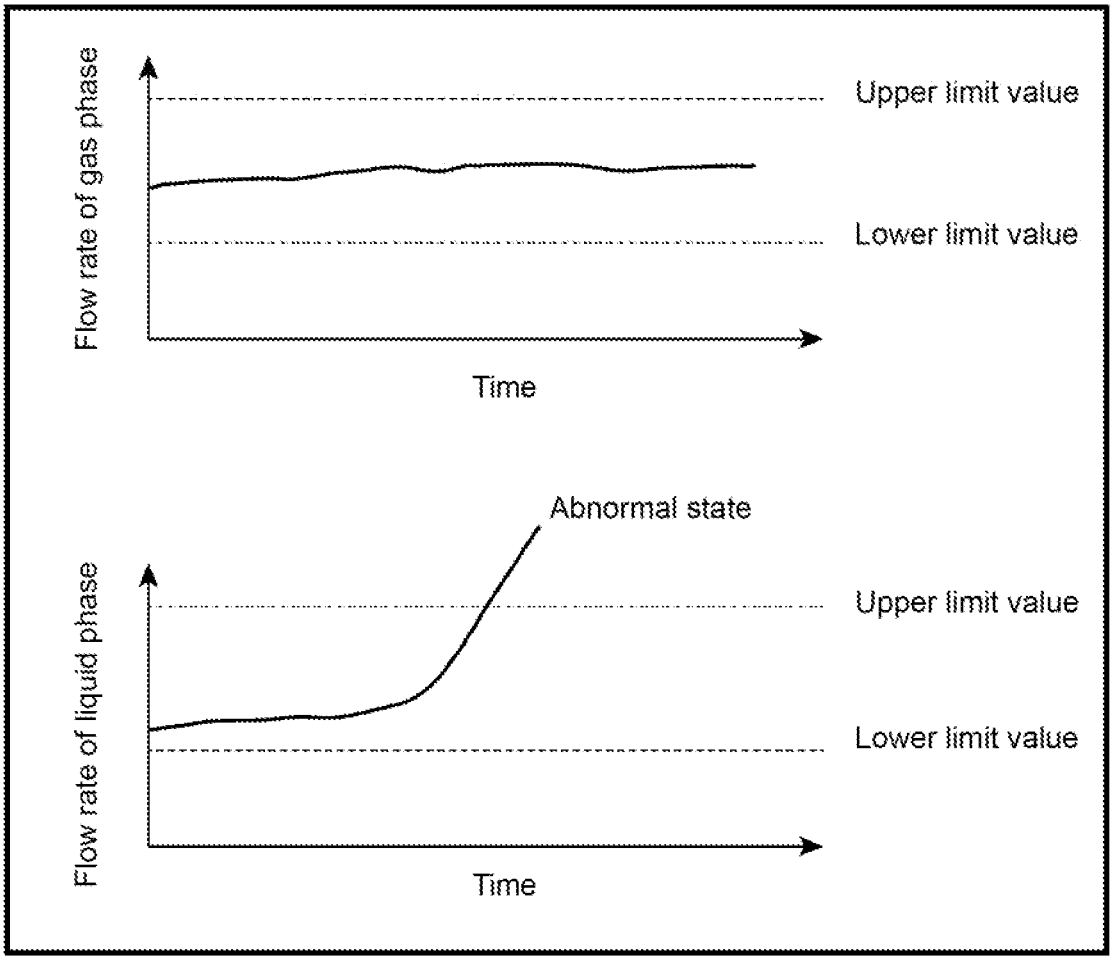
FIG. 6 is a graph showing an example of abnormality detection in drain removal.

For example, as shown in FIG. 6, if the flow rate of the liquid phase may increase and exceed the upper limit value even though the flow rate of the gas phase fluctuates between the upper limit value and the lower limit value, the control device 20 (see FIG. 3) determines that there is a possibility of an increase in wetness of main steam. Such state also increases the risk of erosion damage. However, since such abnormality cannot be recovered by control, early notification of the abnormality can be used as preventive measures for troubles, such as advancing a regular inspection period.

Thus, the control device 20 can automatically detect the occurrence of the abnormality in drain removal and its cause.

In Embodiment 1, in the case where the drain removal monitoring equipment 10 includes the control device 20, it may be configured such that the control device 20 is set with the upper limit value for the value detected by the liquid-phase amount detection part 22, and the drainage valve 23 is opened if the value detected by the liquid-phase amount detection part 22 reaches the upper limit value.

Embodiment 2

Next, the drain removal monitoring equipment according to Embodiment 2 will be described. The drain removal monitoring equipment according to Embodiment 2 is obtained by adding, to Embodiment 1, a bypass line through which the two-phase flow line 16 and the gas-phase return line 15 communicate with each other. In Embodiment 2, the same constituent elements as those in Embodiment 1 are associated with the same reference characters and not described again in detail.

Figure 7:
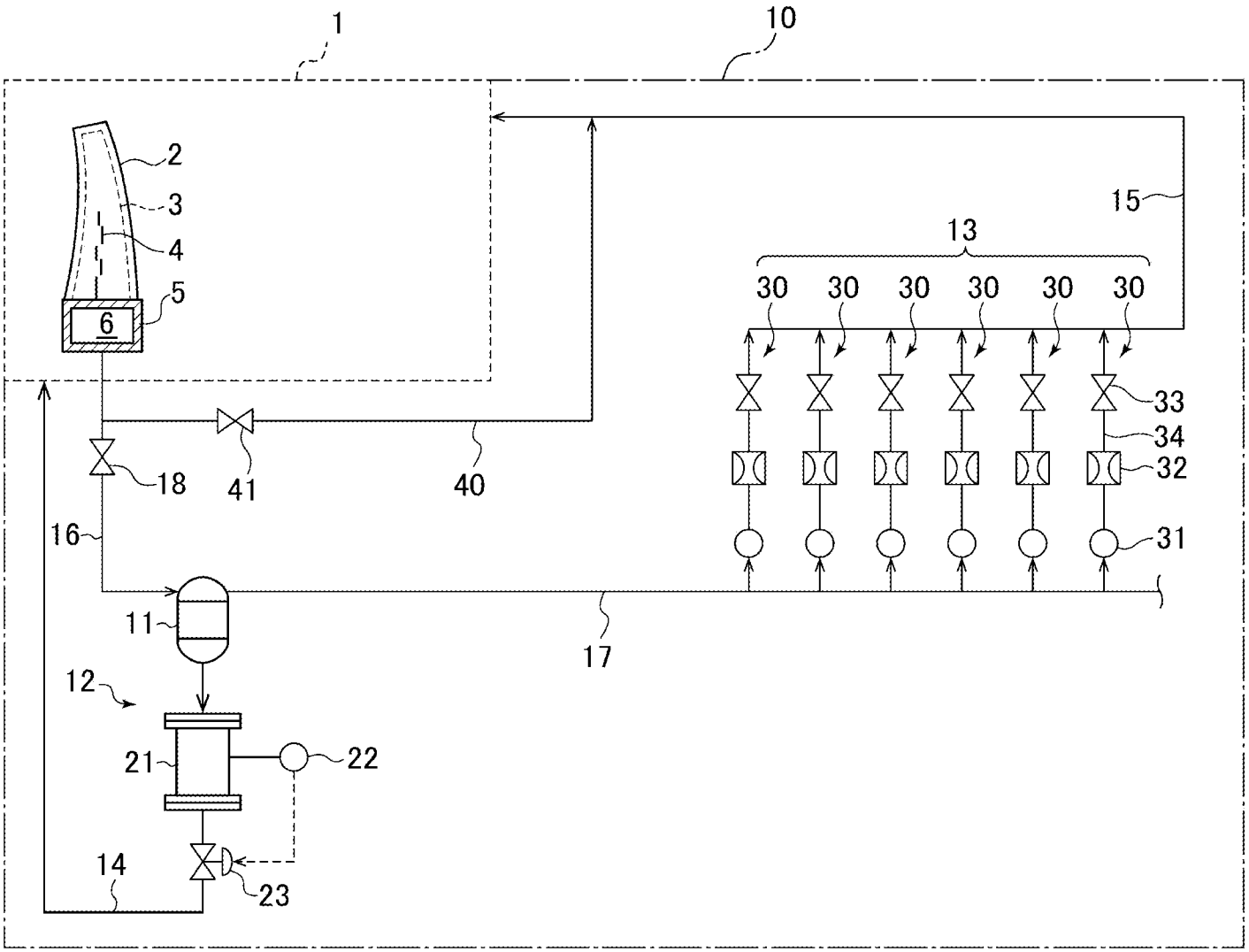
FIG. 7 is a schematic view showing the configuration of the drain removal monitoring equipment according to Embodiment 2 of the present disclosure.

As shown in FIG. 7, the drain removal monitoring equipment 10 according to Embodiment 2 of the present disclosure includes a bypass line 40 through which the two-phase flow line 16 and the gas-phase return line 15 communicate with each other. The bypass line 40 is provided with an opening and closing valve 41, and the two-phase flow line 16 is provided with an opening and closing valve 18 downstream of a connection position with the bypass line 40. Other configurations are the same as Embodiment 1.

In Embodiment 2, when the flow rates of the liquid phase and the gas phase are measured, the opening and closing valve 18 is opened and the opening and closing valve 41 is closed. On the other hand, if it is not necessary to measure the flow rates of the liquid phase and the gas phase, the fluid drawn into the internal space 3 can be returned to the steam turbine 1 via the bypass line 40 and the gas-phase return line 15 by closing the opening and closing valve 18 and opening the opening and closing valve 41. Thus, it is possible to reduce power consumption for flow measurement. Further, it is also possible to perform maintenance of the liquid-phase flow measurement device and the gas-phase flow measurement device while continuing the operation of the steam turbine 1.

Embodiment 3

Next, the drain removal monitoring equipment according to Embodiment 3 will be described. The drain removal monitoring equipment according to Embodiment 3 is obtained by adding, to Embodiment 1 or 2, a first communication line through which the tank part 21 and the gas-phase return line 15 communicate with each other. Hereinafter, Embodiment 3 will be described with a configuration obtained by adding the first communication line to the configuration of Embodiment 2. However, Embodiment 3 may be configured by adding the first communication line to the configuration of Embodiment 1. In Embodiment 3, the same constituent elements as those in Embodiment 2 are associated with the same reference characters and not described again in detail.

Figure 8:
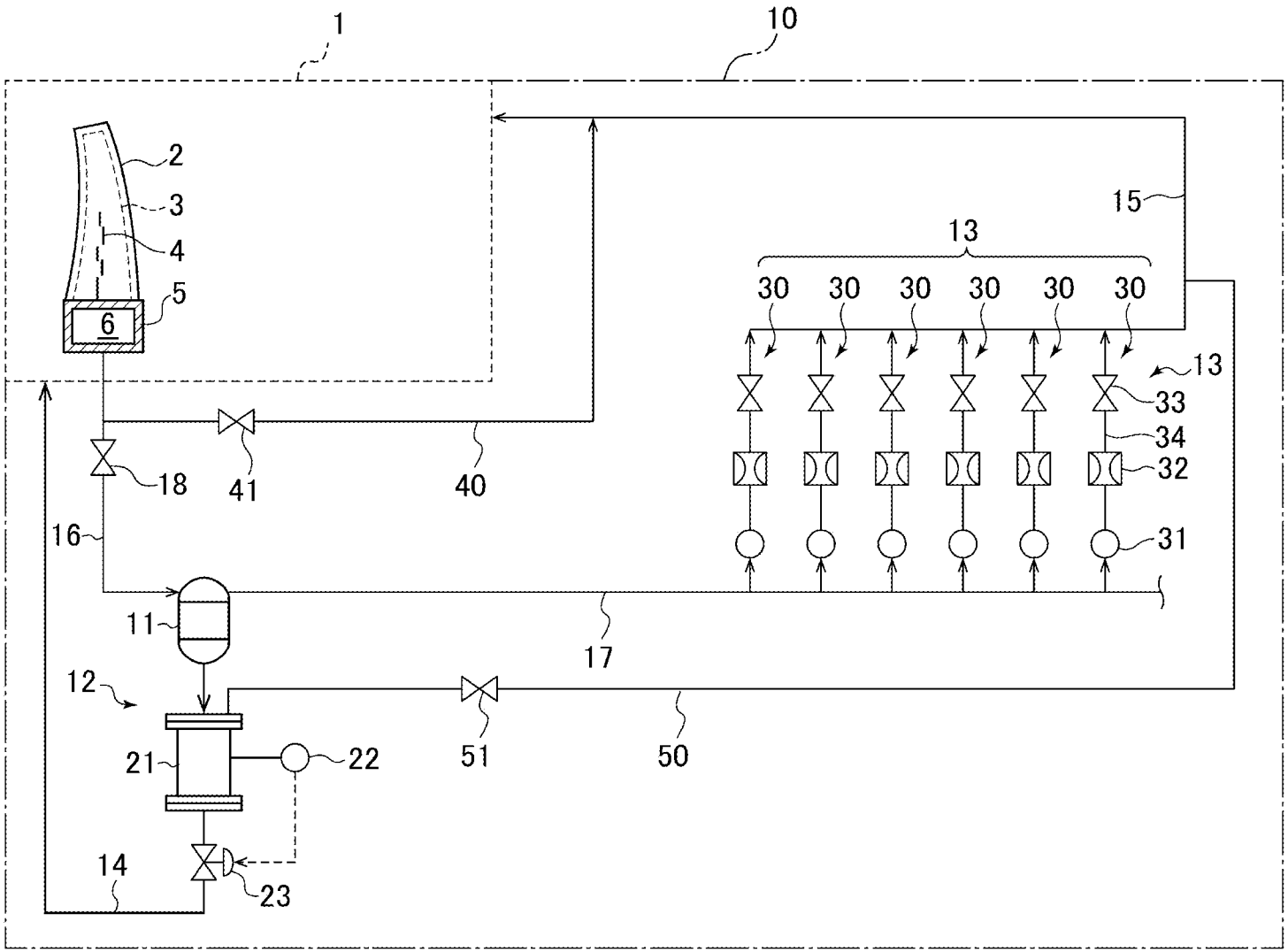
FIG. 8 is a schematic view showing the configuration of the drain removal monitoring equipment according to Embodiment 3 of the present disclosure.

As shown in FIG. 8, the drain removal monitoring equipment 10 according to Embodiment 3 of the present disclosure includes a first communication line 50 through which the tank part 21 and the gas-phase return line 15 communicate with each other. The first communication line 50 is provided with an opening and closing valve 51. Other configurations are the same as Embodiment 2.

The liquid phase separated by the gas-liquid separation device 11 is transferred to the tank part 21 due to a pressure difference between the gas-liquid separation device 11 and the tank part 21. However, if the pressure difference is small, the liquid phase is less likely to be transferred to the tank part 21. To cope therewith, in Embodiment 3, if the opening and closing valve 51 is opened, the pressure in the tank part 21 can be made equal to the downstream pressure of the gas-phase flow measurement device 13 via the first communication line 50, making it possible to increase the pressure difference. Consequently, the transfer of the liquid phase from the gas-liquid separation device 11 to the tank part 21 is promoted, and reliability of flow measurement of the liquid phase can be enhanced.

Embodiment 4

Next, the drain removal monitoring equipment according to Embodiment 4 will be described. The drain removal monitoring equipment according to Embodiment 4 is obtained by adding, to Embodiment 3, a second communication line through which the gas-phase flow line 17 and the first communication line 50 communicate with each other. In Embodiment 4, the same constituent elements as those in Embodiment 3 are associated with the same reference characters and not described again in detail.

Figure 9:
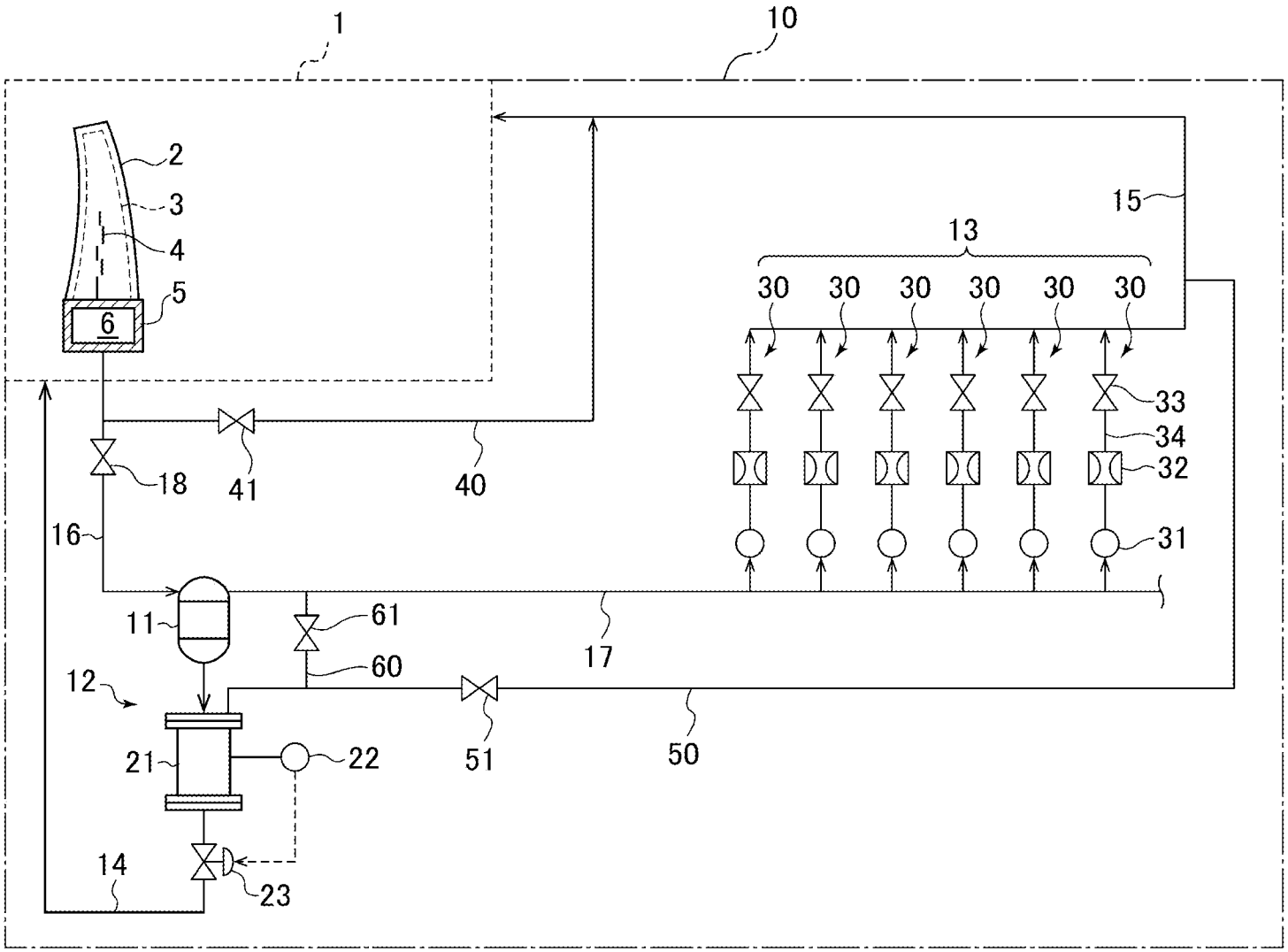
FIG. 9 is a schematic view showing the configuration of the drain removal monitoring equipment according to Embodiment 4 of the present disclosure.

As shown in FIG. 9, the drain removal monitoring equipment 10 according to Embodiment 4 of the present disclosure includes a second communication line 60 through which the gas-phase flow line 17 and the first communication line 50 communicate with each other. The second communication line 60 is provided with an opening and closing valve 61. Other configurations are the same as Embodiment 3.

In Embodiment 4, if the opening and closing valve 61 is opened, the liquid phase staying in the gas-phase flow line 17 can be transferred to the tank part 21 via the second communication line 60, making it possible to improve reliability of flow measurement of the gas phase.

Embodiment 5

Next, the drain removal monitoring equipment according to Embodiment 5 will be described. The drain removal monitoring equipment according to Embodiment 5 is obtained by modifying any of Embodiments 1 to 4 to include a plurality of stator vanes 2 to be measured. Hereinafter, Embodiment 5 will be described with a configuration obtained by modifying the configuration of Embodiment 1 to include the plurality of stator vanes 2 to be measured. However, Embodiment 5 may be configured by modifying any of Embodiments 2 to 4 to include the plurality of stator vanes 2 to be measured. In Embodiment 5, the same constituent elements as those in Embodiment 1 are associated with the same reference characters and not described again in detail.

<Configuration of Drain Removal Monitoring Equipment According to Embodiment 5 of Present Disclosure>

Figure 10:
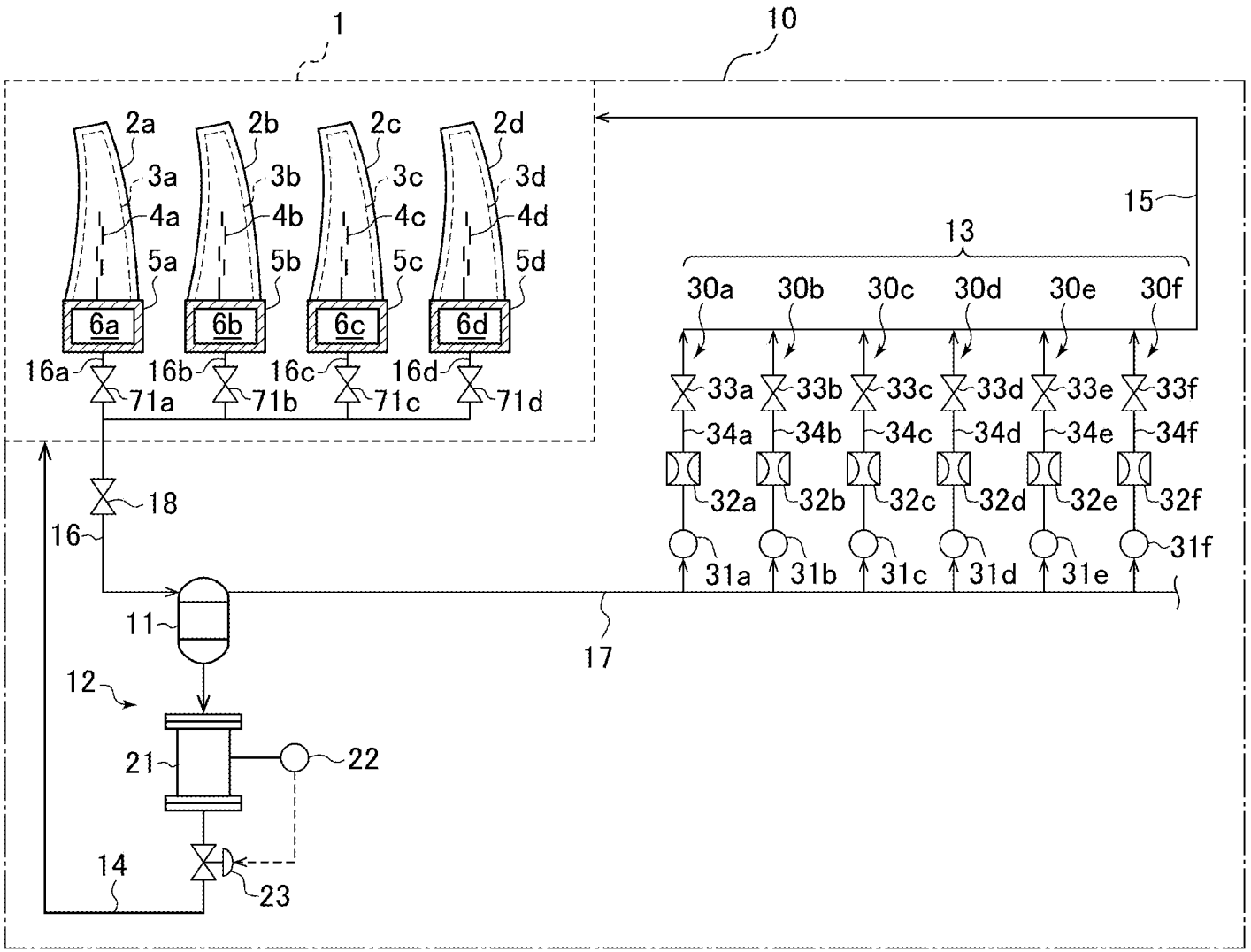
FIG. 10 is a schematic view showing the configuration of the drain removal monitoring equipment according to Embodiment 5 of the present disclosure.

As shown in FIG. 10, in the drain removal monitoring equipment 10 according to Embodiment 5 of the present disclosure, an upstream end of the two-phase flow line 16 branches into four branch pipes 16*a*, 16*b*, 16*c*, 16*d*, and the respective branch pipes are provided with opening and closing valves 71*a*, 71*b*, 71*c*, 71*d*. The two-phase flow line 16 is provided with the opening and closing valve 18. The branch pipes 16*a*, 16*b*, 16*c*, 16*d* are respectively connected to diaphragms 5*a*, 5*b*, 5*c*, 5*d* so as to communicate with internal spaces 6*a*, 6*b*, 6*c*, 6*d* which are formed in the diaphragms 5*a*, 5*b*, 5*c*, 5*d* respectively connected to four different stator vanes 2*a*, 2*b*, 2*c*, 2*d*. Since the internal spaces

6*a*, 6*b*, 6*c*, 6*d* and respective internal spaces 3*a*, 3*b*, 3*c*, 3*d* of the stator vanes 2*a*, 2*b*, 2*c*, 2*d* communicate with each other, the two-phase flow line 16 causes the internal spaces 3*a*, 3*b*, 3*c*, 3*d* and the gas-liquid separation device 11 to communicate with each other via the internal spaces 6*a*, 6*b*, 6*c*, 6*d* and the branch pipes 16*a*, 16*b*, 16*c*, 16*d*. The configuration where the upstream end of the flow line 16 branches into the four branch pipes is merely an example, and a configuration may be adopted where the flow line 16 branches into two or three, or even at least five branch pipes. Other configurations are the same as Embodiment 1.

<Operation of Drain Removal Monitoring Equipment According to Embodiment 5 of Present Disclosure>

In Embodiment 5, the gas-phase flow measurement device 13 includes six measurement mechanisms 30*a*, 30*b*, 30*c*, 30*d*, 30*e*, 30*f*, and if gas-phase flow pipes 34*a*, 34*b*, 34*c*, 34*d*, 34*e*, 34*f* of the respective measurement mechanisms have different inner diameters, as shown in Table 1, with combination of open and closed states of opening and closing valves 33*a*, 33*b*, 33*c*, 33*d*, 33*e*, 33*f* of the respective measurement mechanisms (the open opening and closing valves are marked with circles in Table 1), it is possible to independently adjust the flow rate of the two-phase flow drawn from slits 4*a*, 4*b*, 4*c*, 4*d* of the respective stator vanes and the pressure ratio between upstream and downstream of the slits 4*a*, 4*b*, 4*c*, 4*d* of the respective stator vanes. In Table 1, the configuration is assumed where the inner diameters of the respective gas-phase flow pipes 34*a*, 34*b*, 34*c*, 34*d*, 34*e*, 34*f* are different, and the inner diameters increase in this order.

TABLE 1

| Flow rate | Opening and closing valve | | | | | |
|---|---|---|---|---|---|---|
| | 33a | 33b | 33c | 33d | 33e | 33f |
| Low | o | | | | | |
| | | o | | | | |
| | | | o | | | |
| | | | | o | | |
| | | | | | o | |
| | | | | | | o |
| | o | | | | | o |
| | | o | | | | o |
| | | | ⋮ | | | |
| | | o | o | o | o | o |
| High | o | o | o | o | o | o |

Figure 11:
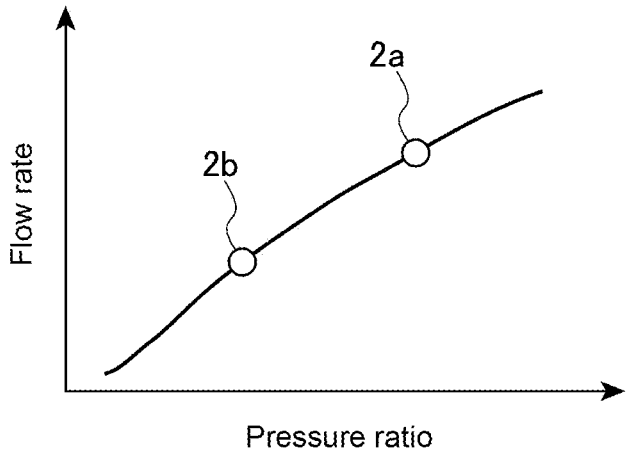
FIG. 11 is a graph schematically showing the relationship between the pressure ratio and the flow rate in the gas-phase flow measurement device including only one measurement mechanism.
Figure 12:
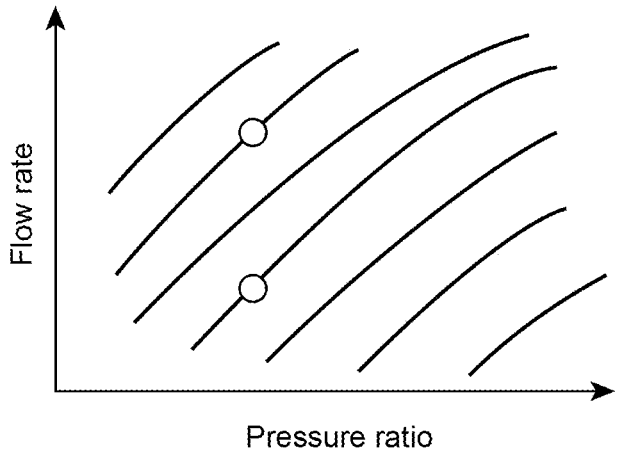
FIG. 12 is a graph schematically showing the relationship between the pressure ratio and the flow rate in the gas-phase flow measurement device including a plurality of measurement mechanisms.

For example, in the gas-phase flow measurement device 13 including only one measurement mechanism, as shown in FIG. 11, if the flow rate of the gas phase decreases due to a change in measurement target from the stator vane 2*a* to the stator vane 2*b*, the relationship between the pressure ratio and the flow rate is fixed at one point, and the flow measurement at an appropriate pressure ratio may be impossible. By contrast, in the gas-phase flow measurement device 13 including the plurality of measurement mechanisms, with the combination of the open and closed states of the opening and closing valves 33*a*, 33*b*, 33*c*, 33*d*, 33*e*, 33*f*, for example, as shown in FIG. 12, it is possible to adjust the flow rate and pressure ratio independently of each other, such as being able to change the flow rate even at the same pressure ratio, and drain can be removed under appropriate conditions.

In Embodiment 5, the plurality of physically separate stator vanes 2*a* to 2*d* have been described as the example of the plurality of measurement targets. However, the present disclosure is not limited to this form. Embodiment 5 assumes that one and the same stator vane having different measurement timings, that is, a plurality of measurements for the one and the same stator vane are also the plurality of measurement targets. In such a case, the upstream end of the two-phase flow line 16 need not branch into the plurality of branch pipes, but the same configuration as in Embodiment 1 may be adopted.

The contents described in the above embodiments would be understood as follows, for instance.

[1] A drain removal monitoring equipment according to one aspect is a drain removal monitoring equipment (10) for monitoring, in a steam turbine (1), drain removal performed by drawing a fluid outside at least one hollow stator vane (2) including an internal space (3) into the internal space (3) via a slit (4) formed in a surface of the stator vane (2), that includes: a gas-liquid separation device (11) for separating the fluid drawn into the internal space (3) into a liquid phase and a gas phase; a liquid-phase flow measurement device (12) for measuring a flow rate of the liquid phase separated by the gas-liquid separation device (11); a gas-phase flow measurement device (13) for measuring a flow rate of the gas phase separated by the gas-liquid separation device (11); a liquid-phase return line (14) through which the liquid-phase flow measurement device (12) and the steam turbine (1) communicate with each other; and a gas-phase return line (15) through which the gas-phase flow measurement device (13) and the steam turbine (1) communicate with each other.

According to drain removal monitoring equipment of the present disclosure, since the flow rates of both the liquid phase and the gas phase in the fluid drawn into the internal space of the stator vane of the steam turbine via a slit formed in the stator vane are measured, it is possible to ascertain whether drain is properly removed.

[2] A drain removal monitoring equipment according to another aspect is the drain removal monitoring equipment as defined in [1], that includes: a two-phase flow line (16) through which the internal space (3) and the gas-liquid separation device (11) communicate with each other; and a bypass line (40) through which the two-phase flow line (16) and the gas-phase return line (15) communicate with each other.

With such configuration, if it is not necessary to measure the flow rates of the liquid phase and the gas phase, the fluid drawn into the internal space can be returned to the steam turbine via the bypass line and the gas-phase return line. Thus, it is possible to reduce power consumption for flow measurement. Further, it is also possible to perform maintenance of the liquid-phase flow measurement device and the gas-phase flow measurement device while continuing the operation of the steam turbine.

[3] A drain removal monitoring equipment according to still another aspect is the drain removal monitoring equipment as defined in [1] or [2], where the liquid-phase flow measurement device (12) includes a tank part (21) for storing the liquid phase, and the drain removal monitoring equipment includes a first communication line (50) through which the tank part (21) and the gas-phase return line (15) communicate with each other.

The liquid phase separated by the gas-liquid separation device is transferred to the tank part due to a pressure difference between the gas-liquid separation device and the tank part. However, if the pressure difference is small, the liquid phase is less likely to be transferred to the tank part. To cope therewith, with the above configuration [3], since the pressure difference can be increased, the transfer of the liquid phase from the gas-liquid separation device to the tank part is promoted, and reliability of flow measurement of the liquid phase can be enhanced.

[4] A drain removal monitoring equipment according to yet another aspect is the drain removal monitoring equipment as defined in [3], that includes: a gas-phase flow line (17) through which the gas-liquid separation device (11) and the gas-phase flow measurement device (13) communicate with each other, and a second communication line (60) through which the gas-phase flow line (17) and the first communication line (50) communicate with each other.

With such configuration, the liquid phase staying in the gas-phase flow line can be transferred to the tank part, making it possible to improve reliability of flow measurement of the gas phase.

[5] A drain removal monitoring equipment according to yet another aspect is the drain removal monitoring equipment as defined in any one of [1] to [4], where the gas-phase flow measurement device (13) includes a plurality of measurement mechanisms (30), and each of the plurality of measurement mechanisms (30) includes: a pressure gauge (31) for measuring a pressure of the gas phase; a critical nozzle (32) disposed downstream of the pressure gauge (31); and an opening and closing valve (33) disposed upstream or downstream of the pressure gauge (31) and the critical nozzle (32).

With such configuration, the number of measurement mechanisms used for flow measurement of the gas-phase can be adjusted by opening and closing the opening and closing valve of each measurement mechanism. Thus, even if the stator vanes to be measured are changed or even if the number of stator vanes to be measured is changed, conditions between the pressure difference between upstream and downstream of the slit and the flow rate of the two-phase flow including the liquid phase and the gas phase are appropriately adjusted by adjusting the number of used measurement instruments, making it possible to appropriately perform flow measurement of the gas phase.

[6] A drain removal monitoring equipment according to yet another aspect is the drain removal monitoring equipment as defined in [5], where the critical nozzle (32) is a Laval nozzle.

By using the critical nozzle in the gas-phase flow measurement device, the flow rate of the gas-phase can be measured only by an upstream pressure of the critical nozzle. However, if the downstream pressure of the gas-phase flow measurement device increases due to operating conditions of the steam turbine, the critical pressure ratio may not be reached in the critical nozzle. Even if the downstream pressure of the gas-phase flow measurement device increases, the possibility of reaching the critical pressure ratio can be increased by using the Laval nozzle as the critical nozzle, making it possible to enhance reliability of flow measurement of the gas phase.

[7] A drain removal monitoring equipment according to yet another aspect is the drain removal monitoring equipment as defined in any one of [1] to [6], where the gas-liquid separation device (11) is a cyclone separator.

With such configuration, it is possible to perform gas-liquid separation for the flow rate of a fluid in a wide range.

[8] A drain removal monitoring equipment according to yet another aspect is the drain removal monitoring equipment as defined in any one of [1] to [7], where the liquid-phase flow measurement device (12) includes: a tank part (21) for storing the liquid phase; and a liquid-phase amount detection part (22) for detecting an amount of the liquid phase in the tank part (21).

With such configuration, it is possible to acquire the flow rate of the liquid phase over time.

[9] A drain removal monitoring equipment according to yet another aspect is the drain removal monitoring equipment as defined in [8], where the liquid-phase return line (14) is connected to the tank part (21), and the liquid-phase return line (14) is provided with a drainage valve (23) configured to open if a value detected by the liquid-phase amount detection part (22) reaches a preset upper limit value.

With such configuration, since the liquid phase can automatically be drained from the tank part if the liquid-phase amount in the tank part reaches the upper limit value, long-term monitoring is possible.

[10] A drain removal monitoring equipment according to yet another aspect is the drain removal monitoring equipment as defined in any one of [1] to [9], that includes a control device (20) to which the flow rate of the liquid phase and the flow rate of the gas phase measured by the liquid-phase flow measurement device (12) and the gas-phase flow measurement device (13) are transmitted. The control device (20) is preset with an upper limit value and a lower limit value for the flow rate of the liquid phase, and an upper limit value and a lower limit value for the flow rate of the gas phase. The control device (20) detects an abnormality in the drain removal based on the flow rate of the liquid phase and the flow rate of the gas phase respectively transmitted from the liquid-phase flow measurement device (12) and the gas-phase flow measurement device (13), and the upper limit value and the lower limit value for the flow rate of the liquid phase and the upper limit value and the lower limit value for the flow rate of the gas phase.

With such configuration, it is possible to automatically detect occurrence of the abnormality in drain removal and its cause.

REFERENCE SIGNS LIST

1 Steam turbine
2 Stator vane
3 Internal space
4 Slit
10 Drain removal monitoring equipment
11 Gas-liquid separation device
12 Liquid-phase flow measurement device
13 Gas-phase flow measurement device
14 Liquid-phase return line
15 Gas-phase return line
16 Two-phase flow line
20 Control device
21 Tank part
22 Liquid-phase amount detection part
23 Drainage valve
30 Measurement mechanism
31 Pressure gauge
32 Critical nozzle
33 Opening and closing valve
40 Bypass line
50 First communication line
60 Second communication line

The invention claimed is:

1. A drain removal monitoring equipment for monitoring, in a steam turbine, drain removal performed by drawing a fluid outside at least one hollow stator vane including an internal space into the internal space via a slit formed in a surface of the stator vane, comprising:

a gas-liquid separation device for separating the fluid drawn into the internal space into a liquid phase and a gas phase;

a liquid-phase flow measurement device for measuring a flow rate of the liquid phase separated by the gas-liquid separation device;

a gas-phase flow measurement device for measuring a flow rate of the gas phase separated by the gas-liquid separation device;

a liquid-phase return line connecting the liquid-phase flow measurement device and a condenser of the steam turbine;

a gas-phase return line connecting the gas-phase flow measurement device and a steam supply line which supplies steam to the steam turbine, wherein the liquid-phase flow measurement device includes a tank part for storing the liquid phase, and wherein the drain removal monitoring equipment comprises a first communication line through which the tank part and the gas-phase return line communicate with each other.

2. The drain removal monitoring equipment according to claim 1, comprising:

a two-phase flow line through which the internal space and the gas-liquid separation device communicate with each other; and a bypass line through which the two-phase flow line and the gas-phase return line communicate with each other.

3. The drain removal monitoring equipment according to claim 1, comprising:

a gas-phase flow line through which the gas-liquid separation device and the gas-phase flow measurement device communicate with each other; and a second communication line through which the gas-phase flow line and the first communication line communicate with each other.

4. The drain removal monitoring equipment according to claim 1, wherein the gas-phase flow measurement device includes a plurality of measurement mechanisms, and wherein each of the plurality of measurement mechanisms includes:

a pressure gauge for measuring a pressure of the gas phase;

a critical nozzle disposed downstream of the pressure gauge; and an opening and closing valve disposed upstream or downstream of the pressure gauge and the critical nozzle.

5. The drain removal monitoring equipment according to claim 4, wherein the critical nozzle is a Laval nozzle.

6. The drain removal monitoring equipment according to claim 1, wherein the gas-liquid separation device is a cyclone separator.

7. The drain removal monitoring equipment according to claim 1, wherein the liquid-phase flow measurement device includes:

a tank part for storing the liquid phase; and a liquid-phase amount detection part for detecting an amount of the liquid phase in the tank part.

8. The drain removal monitoring equipment according to claim 7, wherein the liquid-phase return line is connected to the tank part, and wherein the liquid-phase return line is provided with a drainage valve configured to open if a value detected by the liquid-phase amount detection part reaches a preset upper limit value.

9. The drain removal monitoring equipment according to claim 1, comprising:

a control device to which the flow rate of the liquid phase and the flow rate of the gas phase measured by the liquid-phase flow measurement device and the gas-phase flow measurement device are transmitted, wherein the control device is preset with an upper limit value and a lower limit value for the flow rate of the liquid phase, and an upper limit value and a lower limit value for the flow rate of the gas phase, and wherein the control device detects an abnormality in the drain removal based on the flow rate of the liquid phase and the flow rate of the gas phase respectively transmitted from the liquid-phase flow measurement device and the gas-phase flow measurement device, and the upper limit value and the lower limit value for the flow rate of the liquid phase and the upper limit value and the lower limit value for the flow rate of the gas phase.

* * * * *